US008408387B2

(12) United States Patent
Sottile

(10) Patent No.: US 8,408,387 B2
(45) Date of Patent: Apr. 2, 2013

(54) HOLDER FOR REMOVABLY STORING CIRCULAR DISC-LIKE OBJECTS

(76) Inventor: Valerian F Sottile, Savannah, GA (US)

( * ) Notice: Subject to any disclaimer, the term of this patent is extended or adjusted under 35 U.S.C. 154(b) by 0 days.

(21) Appl. No.: 13/323,988

(22) Filed: Dec. 13, 2011

(65) Prior Publication Data

US 2012/0145565 A1 Jun. 14, 2012

Related U.S. Application Data

(60) Provisional application No. 61/422,281, filed on Dec. 13, 2010.

(51) Int. Cl.
*A45C 1/00* (2006.01)

(52) U.S. Cl. ..... 206/0.82; 206/445; 206/818

(58) Field of Classification Search ..... 206/0.8, 206/0.81, 0.815, 0.82, 0.83, 0.84, 445, 38, 206/818; 220/230
See application file for complete search history.

(56) References Cited

U.S. PATENT DOCUMENTS

| | | | | |
|---|---|---|---|---|
| 569,675 | A | 10/1896 | Seiler | |
| 843,050 | A | 2/1907 | Wallerstedt | |
| D45,355 | S | 3/1914 | Saart | |
| 1,159,535 | A | 11/1915 | Schut | |
| 2,358,262 | A * | 9/1944 | Suess | 206/0.81 |
| D164,522 | S | 9/1951 | Stageberg | |
| 2,569,629 | A | 10/1951 | Everitt | |
| D172,023 | S | 4/1954 | Henry | |
| 2,683,526 | A | 7/1954 | Wheatley | |
| 3,141,546 | A | 7/1964 | Leopoldi | |
| 3,160,186 | A | 12/1964 | Conley | |
| 3,192,747 | A | 7/1965 | Stupell et al. | |
| 3,473,648 | A | 10/1969 | Paluzzi | |
| 3,670,524 | A * | 6/1972 | Korwin | 63/18 |
| 3,964,187 | A | 6/1976 | Stumpf | |
| 3,968,582 | A * | 7/1976 | Jones | 40/27.5 |
| D244,105 | S | 4/1977 | Piekarski | |
| 4,395,043 | A * | 7/1983 | Gargione | 273/239 |
| 4,435,911 | A * | 3/1984 | Jones | 40/27.5 |
| 4,765,154 | A | 8/1988 | Martin | |
| 4,827,640 | A * | 5/1989 | Jones | 40/27.5 |
| 4,907,694 | A | 3/1990 | Miller | |
| 4,972,557 | A | 11/1990 | Williams | |
| 5,020,468 | A * | 6/1991 | Ciminelli | 116/318 |
| 5,167,356 | A | 12/1992 | Williams | |
| 5,219,069 | A * | 6/1993 | Sonnek | 206/0.83 |
| 5,407,064 | A * | 4/1995 | Huang | 206/0.8 |
| D360,070 | S | 7/1995 | DiPaola et al. | |
| 5,488,848 | A * | 2/1996 | Huang | 70/456 R |
| 5,676,376 | A * | 10/1997 | Valley | 273/288 |

(Continued)

FOREIGN PATENT DOCUMENTS

| | | |
|---|---|---|
| DE | 3243577 | 5/1984 |
| DE | 4400027 | 7/1994 |

*Primary Examiner* — Jacob K Ackun
*Assistant Examiner* — Jenine Pagan
(74) *Attorney, Agent, or Firm* — Nixon & Vanderhye PC

(57) ABSTRACT

A holder for removably storing therein circular disc-like objects. The holder comprises a body having a front opening surrounded by a first annular ledge facing a rear portion of the body. The front opening is smaller than the circular objects and the first annular ledge is of a size to support the circular objects thereon such that the circular object in engagement with the first annular ledge is viewed through the front opening. The rear portion of the body has a circular rear opening that is larger than the first annular ledge. A second annular ledge is disposed inwardly of the rear opening and supports a metal ring that is engageable by a circular magnet to releasably close the rear opening and rear portion of the body. The body may be opened by applying rearward pressure through the front opening.

11 Claims, 3 Drawing Sheets

U.S. PATENT DOCUMENTS 5,687,890 A * 11/1997 Wanner ..... 224/163
5,768,915 A * 6/1998 Crumrine et al. ..... 63/29.1
D403,814 S 1/1999 Stanford
D431,341 S 9/2000 DiPaola et al.
D456,986 S 5/2002 Truisi
6,508,466 B1 * 1/2003 Rendleman ..... 273/148 R
D478,721 S 8/2003 Anderton
7,207,091 B2 * 4/2007 Dunaye ..... 24/303
D551,850 S 10/2007 Hagman
D595,924 S 7/2009 Haynes
D599,106 S 9/2009 Babey
D609,457 S 2/2010 Blanford et al.
7,784,655 B2 * 8/2010 Su ..... 224/163
2005/0167288 A1 8/2005 Sottile
2008/0135421 A1 6/2008 Raisner et al.

* cited by examiner

HOLDER FOR REMOVABLY STORING CIRCULAR DISC-LIKE OBJECTS

CROSS-REFERENCES TO RELATED APPLICATIONS

This application claims the priority of provisional Patent Application No. 61/422,281 filed on Dec. 13, 2010.

BACKGROUND OF THE INVENTION

1. Field of the Invention The present invention relates to a holder for removably storing therein one or more circular disc-like objects, such as coins, decorative objects or objects with indicia thereon.

2. Description of the Background Art

From time to time, there exists a need to carry some additional money in the form of coins on one's person. This need may occur when a person is in front of a cashier, at a toll booth or in an environment such as church or a charitable organization where a person might require some additional money to pay a fee or make a donation. Accordingly, there is a need for a simple and compact holder for removably storing coins that may be easily removed therefrom. Such a holder may be carried in a person's pocket or pocketbook or, for example, might be connected to a key holder, a zipper fob, a handbag, a necklace, a bracelet or the like. The holder might be decorated such that it serves as a portion of an item of jewelry such as a necklace, bracelet, pin or the like.

Also, there is a need for such a holder for removably storing other types of circular disc-like objects such as decorative objects or objects with indicia thereon. In these cases, objects with different appearances or indicia would be stored in the holder such that a selected one of them would be positioned at the front of the holder where it would be visible to change the appearance of the holder.

In the prior art, such holders have used a series of moving parts, whether they be hinges and pins, clasps, catches, threads or the like, all of which with normal everyday use wear down via material fatigue. Also, some of the prior art holders are complicated in construction, expensive to manufacture, bulky and/or difficult to use. The holder of the present invention is not subject to the above-described disadvantages and possesses many advantages over the prior art.

BRIEF SUMMARY OF THE INVENTION

The holder of the present invention is used for removably storing therein one or more circular disc-like objects, such as, for example, coins, different types of decorative objects or objects having different indicia thereon. The holder comprises a body with a front portion having a front opening surrounded by a first annular ledge facing a rear portion of the body. The front opening is smaller than the circular objects and the first annular ledge is of a size to support the circular objects thereon such that a circular object in engagement with the first annular ledge is viewed through the front opening.

The rear portion of the body has a circular rear opening with an outer diameter that is larger than the outer diameter of the first annular ledge. A second annular ledge is disposed inwardly of the rear opening and has an inner diameter smaller than the rear opening. The second annular ledge has an outer diameter larger than the rear opening.

A metal ring is positioned on the second annular ledge and has an inner diameter that is substantially the same as the outer diameter of the first annular ledge. The metal ring has an outer diameter larger than the rear opening such that an annular portion of the metal ring is exposed through the rear opening.

A circular magnet has an outer diameter that is substantially the same as the size of the rear opening and is receivable within the rear opening for engagement with the metal ring to close the rear body portion and retain the circular disc-like objects stored within the body.

Rearward pressure applied through the front opening by a person's thumb or other finger to a circular object adjacent to the first annular ledge serves to move the circular objects in the body rearwardly to open the body by moving the magnet rearwardly away from the metal ring and out of the rear opening. In this manner, if the circular objects are coins, they may be used by a person. In the case where the circular objects being stored in the holder are decorative objects or objects with different indicia thereon, the positioning of the circular objects in the holder may be changed such that a selected decorative object or object with indicia thereon is in engagement with the first annular ledge and is viewed through the front opening to change the appearance of the front portion of the holder.

The body of the holder may be provided with a connecting member such as a bail to enable it to be attached to another object such as, for example, a key holder, a zipper fob, handbag, necklace, bracelet or the like.

DETAILED DESCRIPTION OF THE INVENTION

Figure 1:
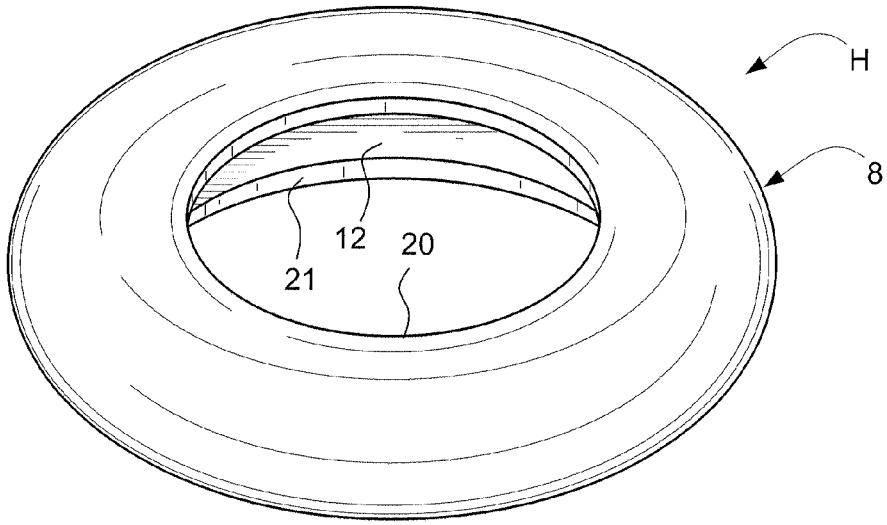
FIG. 1 is a perspective view of the front of one embodiment of the holder of the present invention with no circular disc-like objects stored therein.
Figure 2:
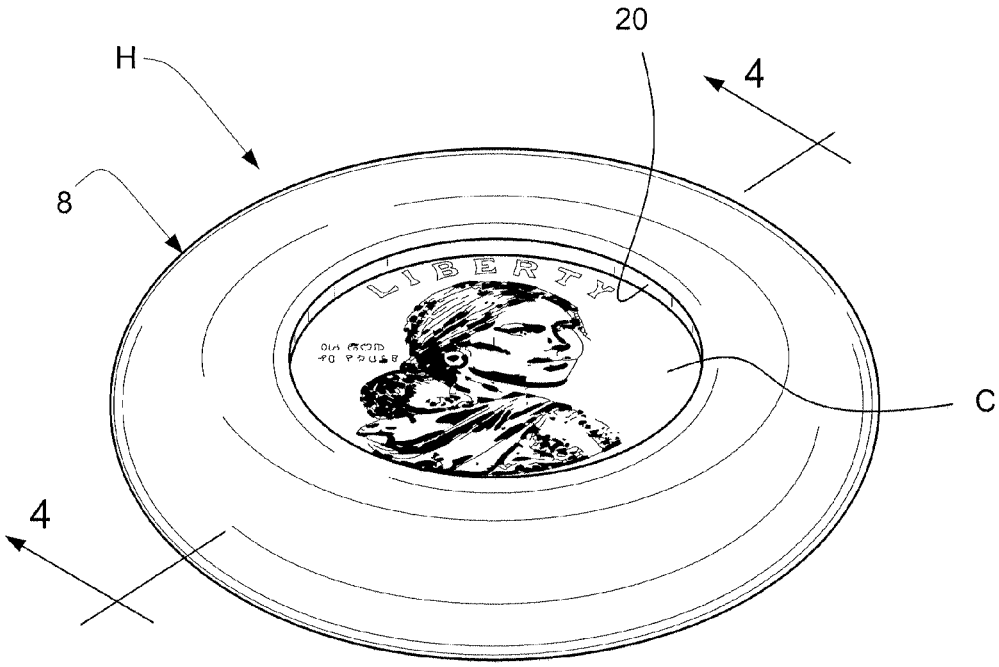
FIG. 2 is a perspective view of the holder of FIG. 1 with a circular disc-like object stored therein and displayed through the front opening of the holder.
Figure 3:
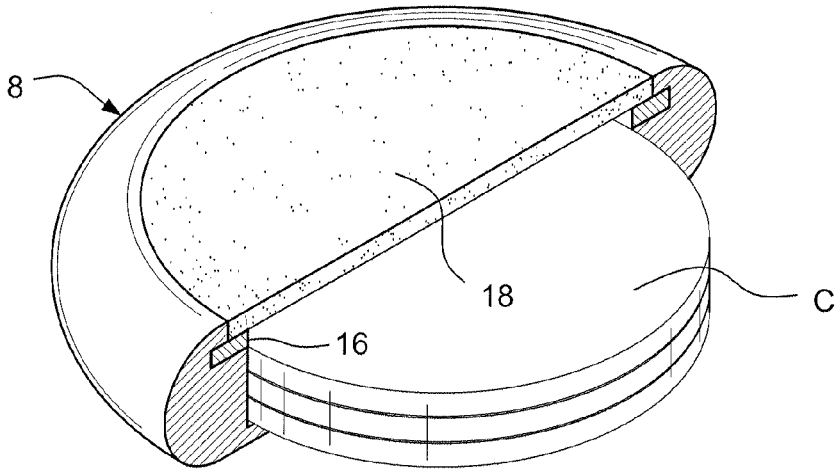
FIG. 3 is a perspective view of the rear of the holder shown in FIG. 1, with parts broken away.
Figure 4:
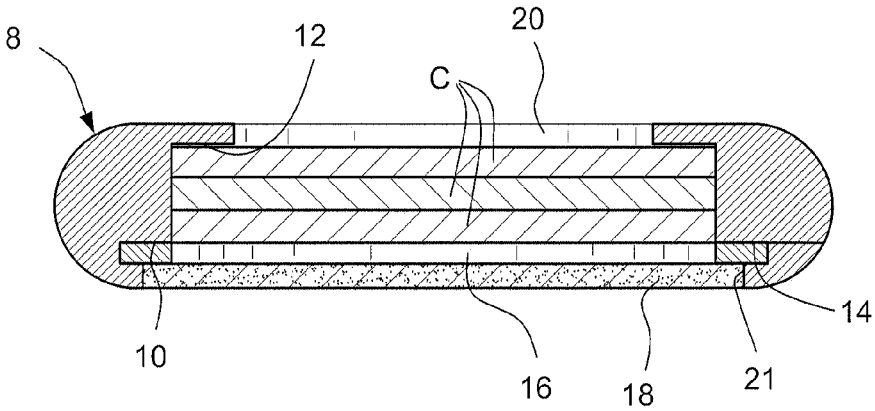
FIG. 4 is a sectional view taken substantially along line 4-4 in FIG. 2.

As shown in FIGS. 1-4, the subject holder H comprises a body 8 formed of any suitable material such as precious metal or plastic. The body 8 has a front portion having a front opening 20 surrounded by a first annular ledge 12 facing a rear portion of the body 8. The front opening 20 is smaller than the circular disc-like objects, such as coins C stored within the body, and the first annular ledge 12 is of a size to support the circular objects C thereon such that the circular object C in engagement with the first annular ledge 12 is viewed through the front opening 20, as shown in FIGS. 2 and 4.

The front opening 20 may be of any suitable shape, such as circular, and is of a size to enable rearward pressure to be applied to a circular object C in engagement with the first annular ledge 12 by a person's thumb, other finger or object to open the holder 8 as will be described more fully hereinafter.

The rear portion of the body 8 has a circular rear opening 21 with an outer diameter that is larger than the outer diameter of the first annular ledge 12. A second annular ledge 10 is disposed inwardly of the rear opening 21 and has an inner diameter smaller than the rear opening 21. The second annular ledge 10 has an outer diameter larger than the rear opening 21, as shown in FIG. 4.

A metal ring 16 is positioned on the second annular ledge 10 and has an inner diameter that is substantially the same size as the outer diameter of the first annular ledge 12. The metal ring 16 has an outer diameter larger than the rear opening 21 such that a portion of the metal ring 16 is exposed through the rear opening, as shown in FIGS. 3 and 4.

Figure 5:
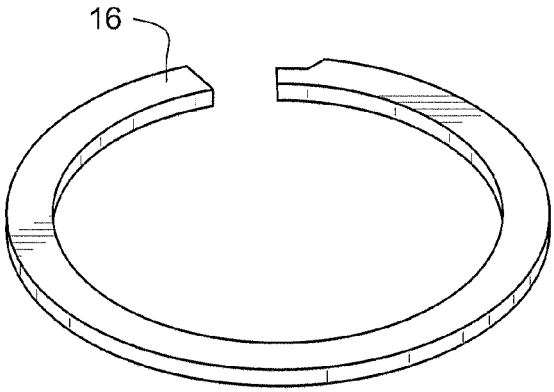
FIG. 5 is a perspective view of a split metal ring that may be used in the holder shown in FIGS. 1-4.

As an illustrative example, FIG. 5 shows the metal ring 16 as a split ring that may be snap-fitted into a recess 14 between the rear opening 21 and the second annular ledge 10, as shown in FIG. 4.

A circular magnet 18 having an outer diameter that is substantially the same as the size of the rear opening 21 is receivable within the rear opening 21 in engagement with the metal ring 16 to releasably close the rear portion of the body 8, as shown in FIGS. 3 and 4. To facilitate the attraction of the magnet 18 to the metal ring 16, the ring 16 is preferably formed of steel and the magnet 18 may be a rare earth magnet. Also, the body 8 is formed of a material other than steel and preferably does not contain iron such that the magnet 18 is attracted to the metal ring 16 and not to the body 8.

In the use of the holder H, one or more circular disc-like objects such as coins C may be stored within the body 8 by stacking them on the first ledge 12 with the magnet 18 removed from the metal ring 16 and thereafter the magnet 18 may be positioned within the rear opening 21 in engagement with the metal ring 16, as shown in FIG. 4, to removably store the circular objects C within the body 8.

When it is desired to remove one or more circular objects C from the body 8 of the holder H, rearward pressure is applied through the front opening 20 by a person's thumb, finger or other object to a circular object C adjacent to the first annular ledge 12 so as to move the circular objects C in the body 8 rearwardly to open the body 8 by moving the magnet 18 rearwardly away from the metal ring 16 and out of the rear opening 21. Similarly, if it is desired to open the holder H when it is empty, a person's finger or other object may be inserted through the front opening 20 to apply rearward pressure on the magnet 18 to remove it from the metal ring 16 and open the rear portion of the body 8.

Instead of coins, the circular disc-like objects may be decorative objects having different colors or designs thereon or having different indicia thereon. In this manner, the appearance of the front portion of the body 8 may be varied by positioning a selected circular object in engagement with the first annular ledge 12 such that it is viewed through the front opening 20 of the body 8. Accordingly, the holder H may serve as a decorative member and/or a coin holder. As an illustrative example, the circular object in engagement with the first annular ledge 12 may be a decorative object viewed through the front opening 20 and coins may be stacked thereon within the body 8.

Figure 6:
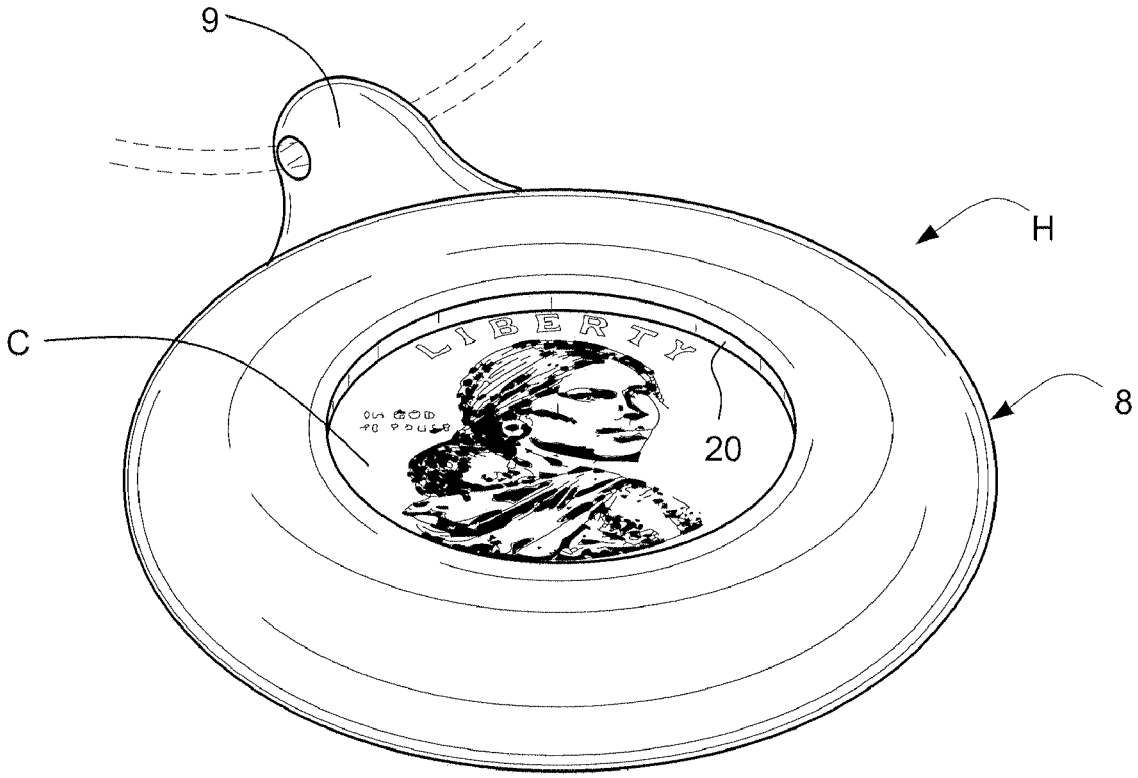
FIG. 6 is a perspective view like FIG. 2 showing a modified embodiment of the holder wherein it has a connecting member for securing it to another object.

A modified embodiment of the holder H is shown in FIG. 6 wherein the body 8 has a connecting portion or member, such as a bail 9, for enabling the holder H to be connected to another object such as a key holder, zipper fob, handbag, necklace, bracelet or the like.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A holder for removably storing one or more circular disc-like objects therein, the holder comprising:

a body with a front portion having a front opening surrounded by a first annular ledge facing a rear portion of the body, the front opening being smaller than the circular objects and the first annular ledge being of a size to support the circular objects thereon such that the circular object in engagement with the first annular ledge is viewed through the front opening, a rear portion of the body having a circular rear opening with an outer diameter that is larger than the outer diameter of the first annular ledge, a second annular ledge disposed inwardly of the rear opening and having an inner diameter smaller than the rear opening, the second annular ledge having an outer diameter larger than the rear opening, a metal ring positioned on said second annular ledge and having an inner diameter that is substantially the same size as the outer diameter of the first annular ledge, the metal ring having an outer diameter larger than the rear opening such that a portion of the metal ring is exposed through the rear opening, and a circular magnet having an outer diameter that is substantially the same as the size of the rear opening and being receivable within the rear opening for engagement with the metal ring to close the rear body portion, whereby rearward pressure applied through the front opening to a circular object adjacent to the first annular ledge serves to move circular objects in the body rearwardly to open the body by moving the magnet rearwardly away from the metal ring and out of the rear opening.

2. The holder of claim 1 wherein the circular disc-like objects are coins, decorative objects or objects with indicia thereon.

3. The holder of claim 1 wherein the metal ring is formed of steel and the magnet is a rare earth magnet.

4. The holder of claim 1 wherein the body is circular in shape.

5. The holder of claim 1 wherein the front opening is of a size to enable a user's finger to apply rearward pressure on the adjacent circular object sufficient to move the magnet rearwardly out of engagement with the metal ring.

6. The holder of claim 5 wherein the front opening is circular.

7. The holder of claim 1 wherein the metal ring is a split ring that is snap-fitted within the body in engagement with the second annular ledge.

8. The holder of claim 1 wherein a rear surface of the magnet is substantially flush with the adjacent rear portion of the body when the magnet is in engagement with the metal ring.

9. The holder of claim 1 wherein the body comprises a connecting member to enable it to be attached to a key holder, zipper fob, handbag, necklace or bracelet.

10. The holder of claim 9 wherein the connecting member is a bail.

11. The holder of claim 1 wherein the body is formed of a precious metal.

* * * * *